US011562634B2

(12) United States Patent
Zhevelev et al.

(10) Patent No.: US 11,562,634 B2
(45) **Date of Patent: *Jan. 24, 2023**

(54) PASSIVE INFRA-RED INTRUSION DETECTOR

(71) Applicant: Tyco Fire & Security GmbH, Neuhausen am Rheinfall (CH)

(72) Inventors: Boris Zhevelev, Rishon le Zion (IL); Yehuda Shviki, Rishon le Zion (IL); Zach Avidar, Emek Yizrael (IL); Vitaly Roytenburd, Rishon le Zion (IL)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 87 days.

This patent is subject to a terminal disclaimer.

(21) Appl. No.: 17/107,487

(22) Filed: Nov. 30, 2020

(65) Prior Publication Data

US 2021/0082264 A1 Mar. 18, 2021

Related U.S. Application Data

(63) Continuation of application No. 16/491,085, filed as application No. PCT/IB2018/051442 on Mar. 6, 2018, now Pat. No. 10,902,706.

(60) Provisional application No. 62/467,650, filed on Mar. 6, 2017.

(51) Int. Cl.
*G08B 13/18* (2006.01)
*G08B 13/193* (2006.01)

(52) U.S. Cl.
CPC ..... *G08B 13/193* (2013.01)

(58) Field of Classification Search
CPC ..... G08B 13/193; G01K 1/08; G01K 1/16
See application file for complete search history.

(56) References Cited

U.S. PATENT DOCUMENTS 4,734,585 A * 3/1988 Owers ..... G08B 13/19 250/353
6,222,191 B1 * 4/2001 Myron ..... G08B 13/193 250/353
6,348,691 B1 * 2/2002 Sandell ..... G08B 13/193 340/567
7,297,953 B2 * 11/2007 Walters ..... G08B 13/193 250/353
7,438,438 B2 * 10/2008 Sandell ..... F21S 8/033 340/552

(Continued)

*Primary Examiner* — Toan N Pham
(74) *Attorney, Agent, or Firm* — ArentFox Schiff LLP

(57) ABSTRACT

A passive infrared motion detector discriminates between the motion of humans and pets in a premises. The motion detector includes an infrared sensor and a mirror for focusing infrared radiation from distinct fields of view. In one embodiment, a mask prevents infrared radiation from reaching the infrared sensor, and cut away regions on the surface of the mask allow selective passage of infrared radiation to the infrared sensor. In an alternative embodiment, the cylindrical mirror elements includes reflective and unreflective regions, which allow selective passage of infrared radiation to the infrared sensor. The cut away regions and the reflective regions are elongated to correspond to the shape of standing humans. As a result, the infrared radiation from animals only partially reaches the infrared sensor.

20 Claims, 12 Drawing Sheets

(56) References Cited

U.S. PATENT DOCUMENTS 10,902,706 B2 * 1/2021 Zhevelev ..... G08B 13/193

* cited by examiner

PASSIVE INFRA-RED INTRUSION DETECTOR

RELATED APPLICATIONS

This application is a continuation of U.S. application Ser. No. 16/491,085, filed Sep. 4, 2019, which is a 35 U.S.C. § 371 National Phase of PCT Application No. PCT/162018/051442, filed Mar. 6, 2018, which claims the benefit of U.S. Provisional Application No. 62/467,650, filed Mar. 6, 2017, the contents of all of the above applications are incorporated herein by reference in their entirety.

BACKGROUND OF THE INVENTION

Security systems are often installed within residences.

These security systems typically include motion detectors for detecting the presence of intruders in the premises. Many motion detectors include passive infra-red (PR) sensors. Lenses or mirrors establish different zones within the area being monitored by condensing infrared radiation from those zones and directing it toward the sensor. As an intruder moves between zones, the PR sensor detects the changes in the levels of infrared radiation across multiple zones and determines that an intruder is present.

In PIR sensors, it is important to prevent pets within the residence, such as cats or dogs, from triggering the motion detector. Pet immunity feature in PR motion detectors is a requirement well documented for the past three decades.

One form of handling pet immunity is by adding an attenuator in the optics design. Such attenuator will be enough to reduce the signal of heat radiation usually in 5 to 14 micrometer wavelength, to a level that the detector algorithm will regard as non-alert. For example, because of the attenuation, the signal level detected by a pet (as opposed to a human) will be below a predefined threshold. One such system is described in U.S. Pat. No. 6,211,522, entitled "PASSIVE INFRA-RED INTRUSION SENSOR", which is hereby incorporated by reference in its entirety, is an example of such a system.

SUMMARY OF THE INVENTION

The present invention concerns the prevention of the detection of pets at floor level. Instead of attenuation of the infrared radiation received by the detector or closing part of the lens in order not to receive radiation from a certain area, the present system adjusts the energy passing to the sensor by placing a pattern mask in the optical path. Preferably, the pattern mask has the effect of providing transmissive slits that will correspond to a standing human.

Generally, humans take the form of long, standing/erect shapes, whereas pets are short and square. By designing apertures to be in the form of vertically extending slits, the infrared radiation from an upright human can pass through the slit(s), whereas infrared radiation from a pet, having a mostly wide, low, elongate rectangular shape, will pass through the slit only partially.

As a whole, the accumulated radiation from a pet may be the same as the accumulated radiation from an upright human. The slit design lets the full human radiation pass while passing only a small portion of the pet radiation. This difference in radiation then translates to signal amplitude received from a pyro-electric sensor (or any type of thermal sensor, e.g. thermopile).

In general, according to one aspect, the invention features an infrared motion detector comprising an infrared sensor for detecting infrared radiation, a mirror for reflecting infrared radiation from distinct fields of view, and a pattern mask for blocking or attenuating infrared radiation from reaching the infrared sensor.

Preferably, the mirror or portion of the mirror that reflects light that is patterned by or will be patterned by the pattern mask has a cylindrical curvature.

In embodiments, the pattern mask comprises a mask body in front of the mirror or patterned reflective regions of the mirror. The pattern mask allows radiation from slit-shaped regions to reach the sensor. The slit-shaped regions provide different azimuthal fields of view. In different examples, the slit-shaped regions have an increasing width over their length, extend completely or only partially through a body of the pattern mask, and a profile of the slit-shaped region changes over the region's depth.

In general, according to another aspect, the invention features a method of operation of an infrared motion detector. This method comprises receiving and reflecting infrared radiation from distinct fields of view, detecting the reflected infrared radiation with a sensor, and blocking or attenuating infrared radiation from reaching the infrared sensor from distinct fields of view with a pattern mask.

In general, according to another aspect, the invention features a passive infrared intrusion detector comprising an infrared sensor for detecting infrared radiation and a mirror, preferably comprising cylindrical optics mirror elements, for focusing infrared radiation from distinct fields of view. Reflective and unreflective portions of the mirror provide selective passage of infrared radiation to the infrared detector.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE PREFERRED EMBODIMENTS

The invention now will be described more fully hereinafter with reference to the accompanying drawings, in which illustrative embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

As used herein, the term "and/or" includes any and all combinations of one or more of the associated listed items. Further, the singular forms and the articles "a", "an" and "the" are intended to include the plural forms as well, unless expressly stated otherwise. It will be further understood that the terms: includes, comprises, including and/or comprising, when used in this specification, specify the presence of stated features, integers, steps, operations, elements, and/or components, but do not preclude the presence or addition of one or more other features, integers, steps, operations, elements, components, and/or groups thereof. Further, it will be understood that when an element, including component or subsystem, is referred to and/or shown as being connected or coupled to another element, it can be directly connected or coupled to the other element or intervening elements may be present.

Figure 1A:
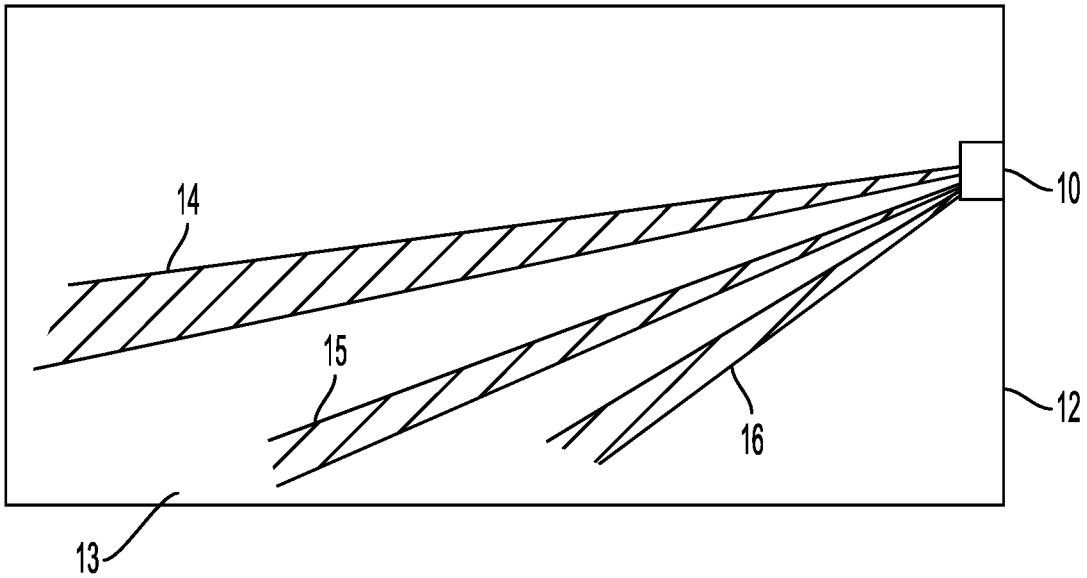
FIG. 1A is a schematic side view of an infrared motion detector installed on a wall with multiple elevational fields of view.

Reference is made to FIG. 1A, showing a side view of an infrared motion detector 10 installed on a wall 12, for example. The motion detector has multiple fields of view: a lower elevation field of view 16, a middle elevation field of view 15, and an upper elevation field of view 14 covering the required protected zone 13.

Figure 1B:
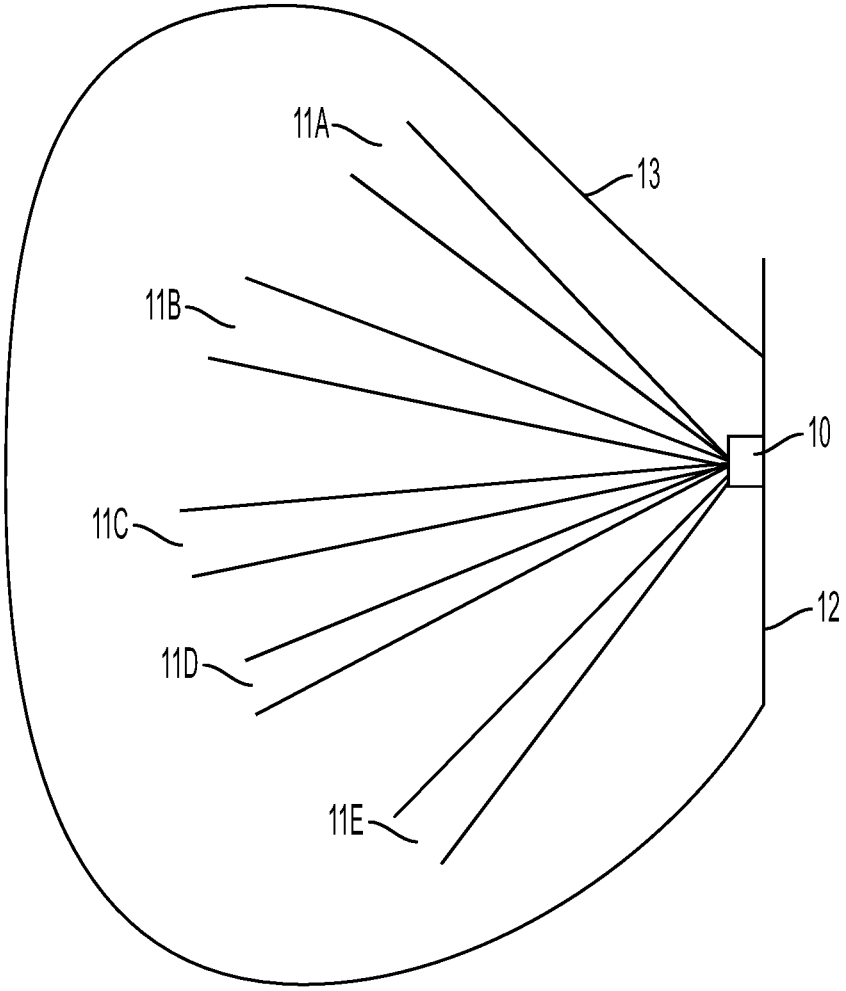
FIG. 1B is a schematic top view of the detector showing its multiple azimuthal fields of view provided by slit-shaped features in a pattern mask, according to the invention.

FIG. 1B shows a top view of the detector 10 on a wall 12 and multiple azimuthal fields of view 11A-11E extending outward as radial slices that cover and divide the protected zone 13 into sectors.

Each of the azimuthal fields of view 11A-11E depicted in FIG. 1B includes one or more of the several elevational fields of view 14, 15, 16 as depicted in the side view of FIG. 1A.

Figure 2:
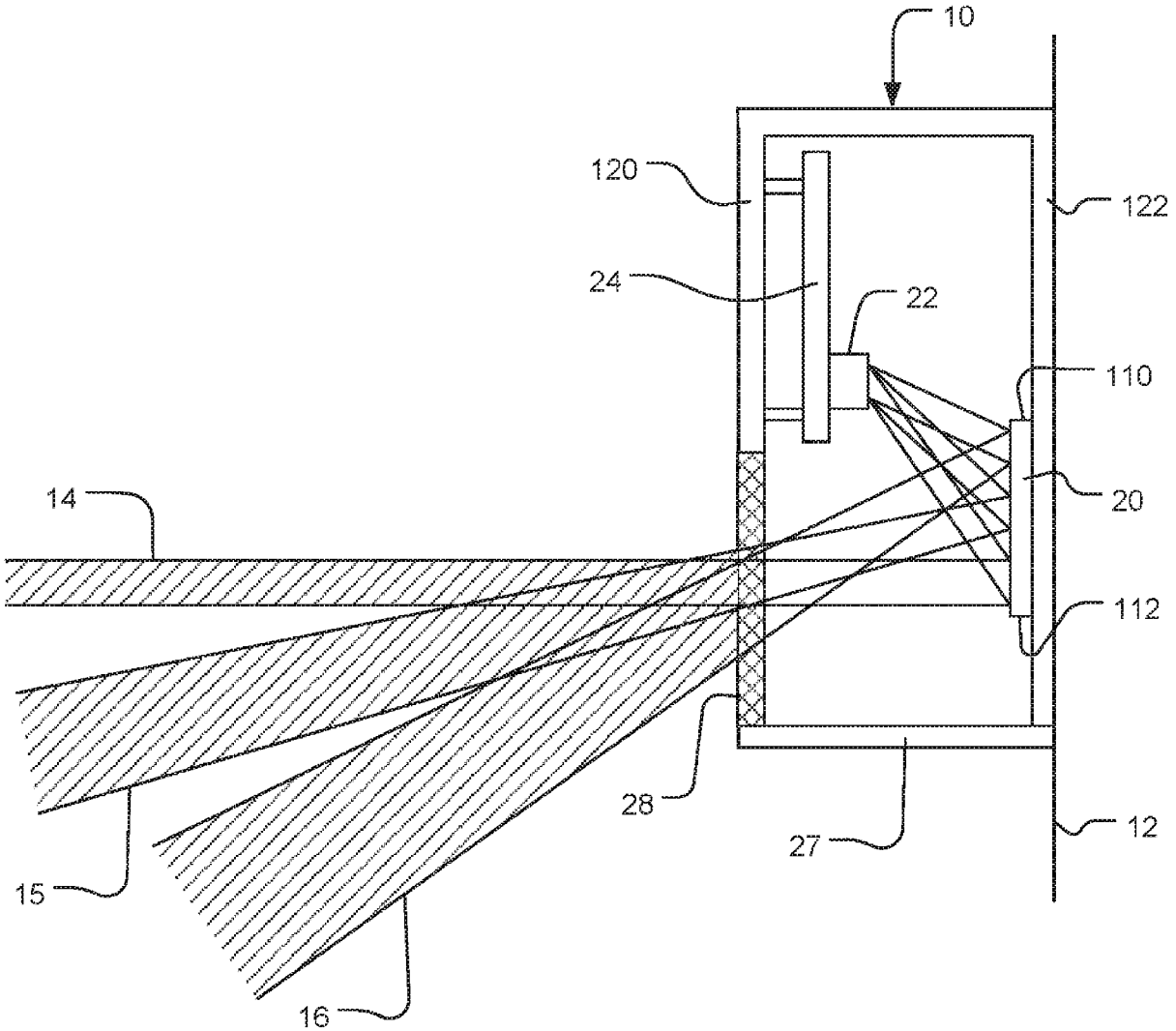
FIG. 2 is schematic side cross-section view of the detector.

FIG. 2 shows side cross sectional view of the detector 10. It includes a housing 27, a window 28 in a front wall 120 of the housing, a mirror 20 secured to an inner side of a rear wall 122 of the housing 27, an electronics board 24 secured to an inner side of the front wall 120, and a pyro-electric sensor 22 installed on the board 24 facing the rear wall. The mirror reflects infrared light received through the window 28 to the pyro-electric sensor 22.

Figure 3A:
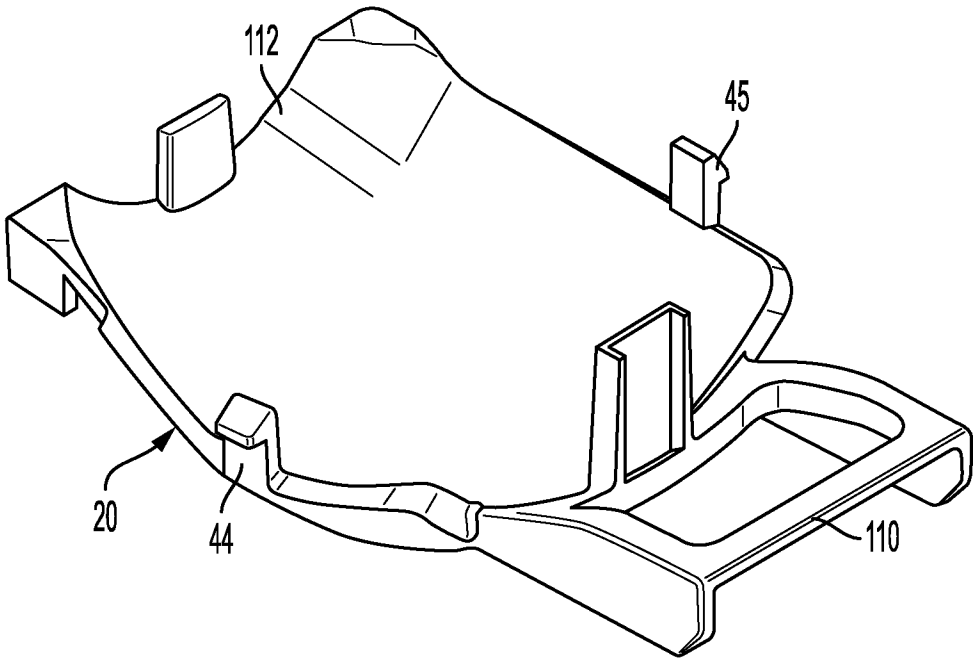
FIGS. 3A and 3B are a perspective view and a front plan view, respectively, of a mirror of an infrared motion detector.
Figure 3B:
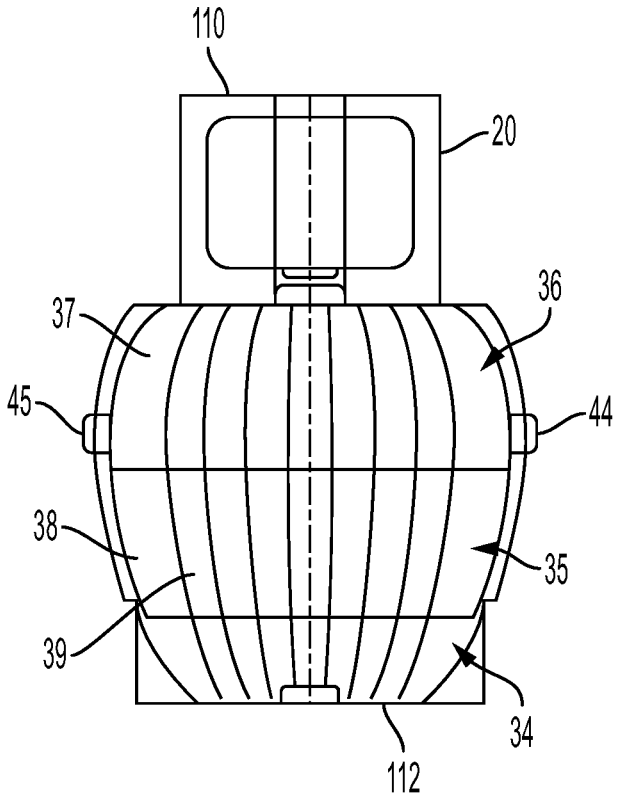

FIGS. 3A and 3B show an example of the design of a typical mirror 20, in which the mirror 20 includes three rows of mirror optical elements 34, 35, 36 located between the bottom 112 and the top 110. These rows 34, 35, 36 extend laterally across the mirror and correspond to and create the elevational fields of view 14, 15, 16, respectively. In each row, each optical mirror element corresponds to a different azimuthal field of view.

It should be noted that in this example the upper row of mirror optical elements 36 of the mirror 20 looks downward or collects light from below the detector and typically covers a range of up to about 8 meters (corresponding to field of view 16 of FIG. 2). The curvature of the elements in the upper row 36 is generally cylindrical.

The lower row 34 of the mirror 20 looks further in range (corresponding to field of view 14 of FIG. 2). Specifically, the lower row 34 collects light in a near horizontal direction to a small range of angles below horizontal.

Finally, the middle row 35 of the mirror 20 collects light from oblique angles between those of the upper row 36 and the lower row 34.

The curvature of the middle row 35 and the lower row 34 are generally parabolic.

Two snap-fit tabs 44, 45 are located on either lateral side of the mirror 25.

It also should be noted that other designs include elevational fields of view in addition to 14, 15, 16 in FIG. 1A, which are defined by more rows in the mirror 20 and/or different types of optical elements beside the rows 37, 38, 39 such as discrete parabolic and cylindrical mirror elements.

Figure 4B:
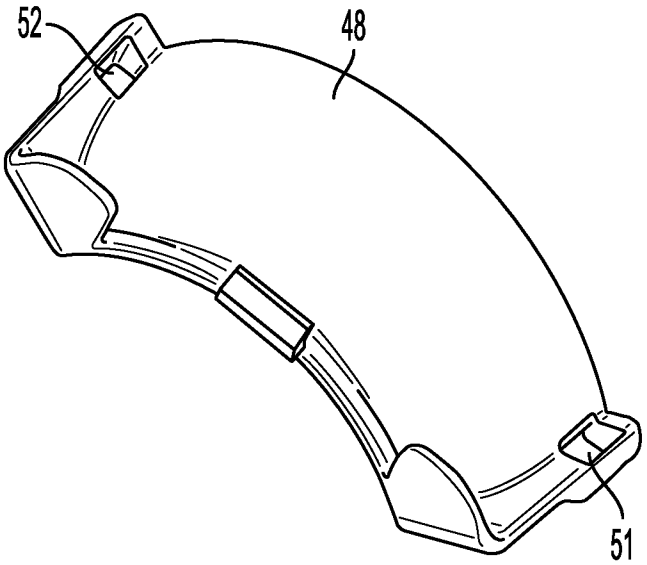
FIGS. 4A and 4B are two scale perspective views of an example of a prior art pet mask.
Figure 4A:
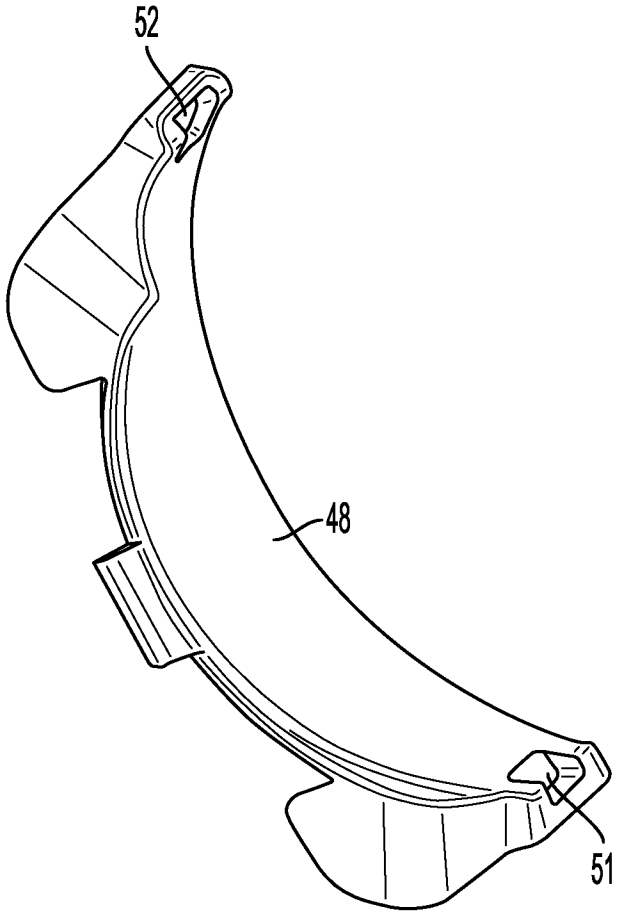

FIGS. 4A and 4B show two views of an example of a prior art pet mask 48.

The prior art pet mask 48 is compatible with and attaches to a mirror 20 such as the one shown in FIG. 3A. The mask 48 includes two through-holes or slots 51, 52. The mask 48 fits over the mirror by sliding the slots 51, 52 over the snap-fit tabs 44, 45 of the mirror 20 respectively.

When assembled, the mask 48 covers a portion of the mirror 20. In general, the mask 20 may have a graded thickness to control the level of attenuation of the infra-red radiation. The mask 48 is placed on the mirror 20 and secured by the snaps 44, 45, and specifically covers the upper portion row 36 of the mirror 20. The mask 48 will thus cover the optical elements of the row 36 that are pointing more downward toward the floor, which in turn corresponds to lower elevational field of view 16. In this way, the pet mask uniformly attenuates radiation coming from pets on the floor in the lower elevational field of view 16.

Instead of uniformly attenuating the signal received by the pyro-electric sensor 22, the present system adjusts the energy passing to the pyro-electric sensor 22 by placing a pattern mask in the optical path. The pattern mask is characterized by vertically-elongated slit-shaped regions in the mask. The shape and orientation of the slits are intended to mimic the general shape of a standing human.

Humans tend to have long, erect, standing shapes. In contrast, most pets are more short and square and laterally elongate, dimensionally. By designing the pattern mask to have vertically-elongated slits, the radiation from an upright human will pass through. Body radiation from a pet having a mostly wide low height rectangular shape will only partially pass through the slit. More specifically, only the body radiation from the portion of the pet within the field of view corresponding to the slit will pass through. Thus, humans will tend to yield a higher response at the pyro-electric sensor 22.

Figure 5B:
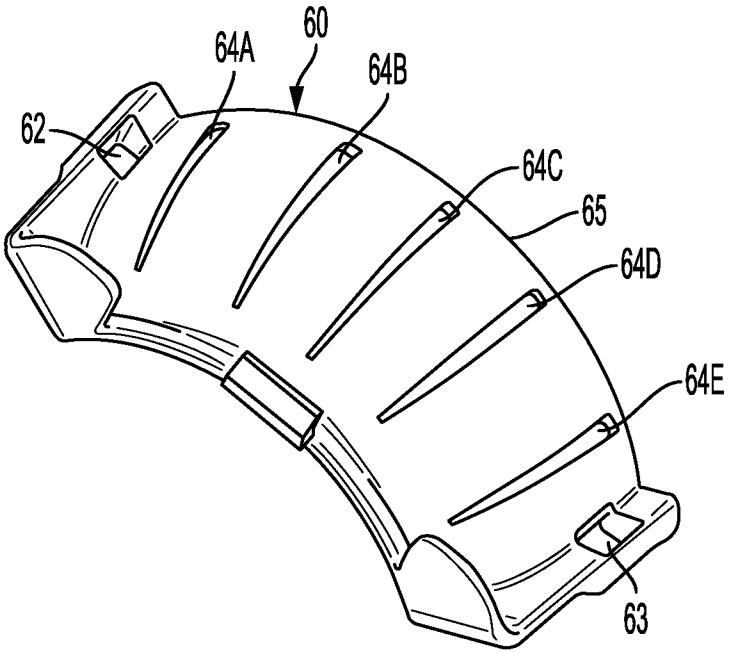
FIGS. 5A and 5B are two scale perspective views of a pet mask that employs a pattern mask according to the present invention.
Figure 5A:
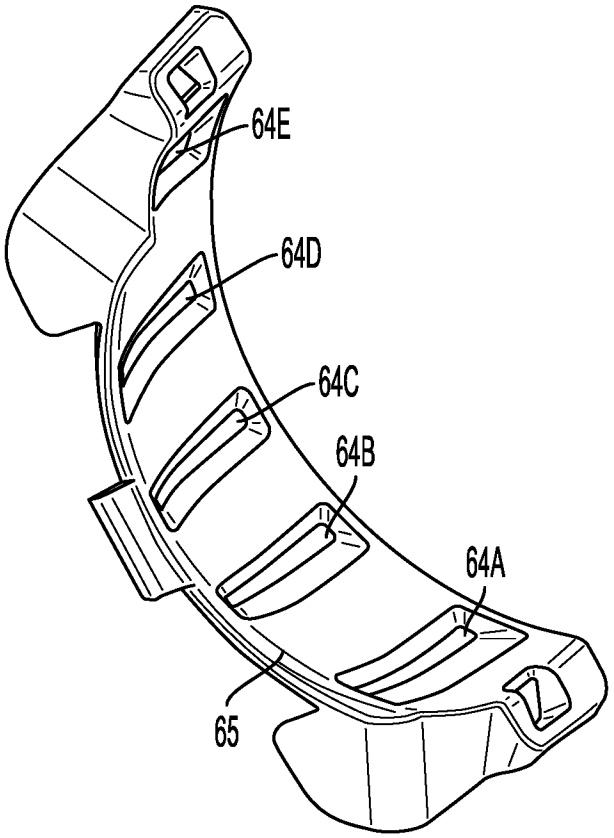

Reference is made to FIGS. 5A and 5B showing a pet mask 60 constructed according to the principles of the present invention.

As before, the mask 60 attaches to the mirror 20. Specifically, the snaps 44, 45 of the mirror 20 are received into through-holes 62, 63 of the pattern mask 60.

The pattern of the mask is characterized by multiple slits 64A-64E in a body 65 of the mask 60, which has a generally hemispherical section-shape. In general the number of slit-shaped features is between 2 and 10, typically between 3 and 7. The illustrated embodiment has 5.

Further, each slit usually has a length of between 8 and 20 millimeters, preferably about 12 millimeters. The width is usually less than 4 millimeters, preferably about 2 millimeters.

Further edges of the slits on the side away from the mirror are beveled as shown in FIG. 5A.

In the preferred embodiment the mask 60 only covers upper row 36 of the mirror 20. The upper row 36 of the mirror 20 looks downward or collects light from below the detector and typically covers a range of up to about 8 meters (corresponding to lower elevational field of view 16 of FIG. 1A). Moreover, the mirror elements of this row have a generally cylindrical curvature In another embodiment, the pattern mask 60 also covers the middle row 35 of the mirror 20. The size of the mask 60 and slits 64 varies according to the specific optical design of the mirror 20 and the mirror elements.

As a whole, even if the accumulated radiation from a pet may be the same as the accumulated radiation from an upright human, the slit pattern of the pattern mask 60 allows all of the radiation from humans to pass through to the mirror 20 and be reflected to the sensor 20, while passing only a small portion of the radiation from pets. This difference in radiation then translates to signal amplitude received from a pyro-electric sensor 20 (or any type of thermal sensor, e.g. thermopile).

The design of the slits 64, including characteristics such as size, shape and profile, should be closely related to the optical design of the mirror 20 and its elements. Parabolic mirror elements may call for a different size of the slit compared to cylindrical mirror elements or mirror elements of other shapes.

The slit design may have multiple shapes and size, corresponding to the optical design and the particular pets that are not to be detected. In particular the design of the slits 64 is based on pet size and temperature, installation height of the detector from floor, field of view and range of detection, mirror optical design, and electronic circuit and algorithm.

FIGS. 6A-6F show alternative slit designs, including alternative shapes and edge profiles according to different embodiments of the present invention.

Figure 6B:
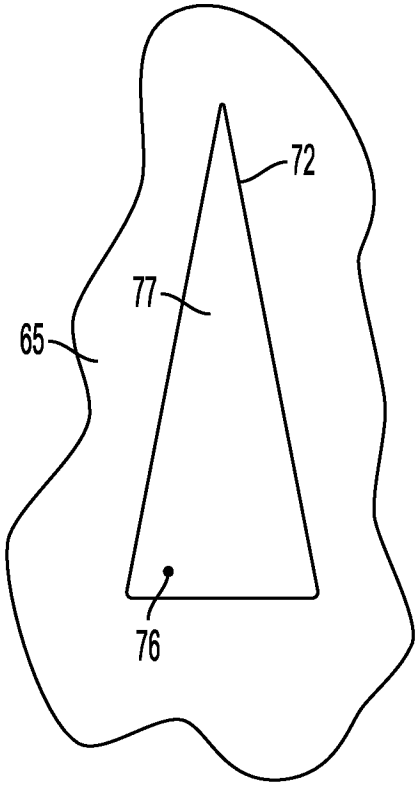
FIGS. 6A, 6B, 6C, 6D, 6E, and 6F show alternative slit designs according to different embodiments of the present invention.
Figure 6A:
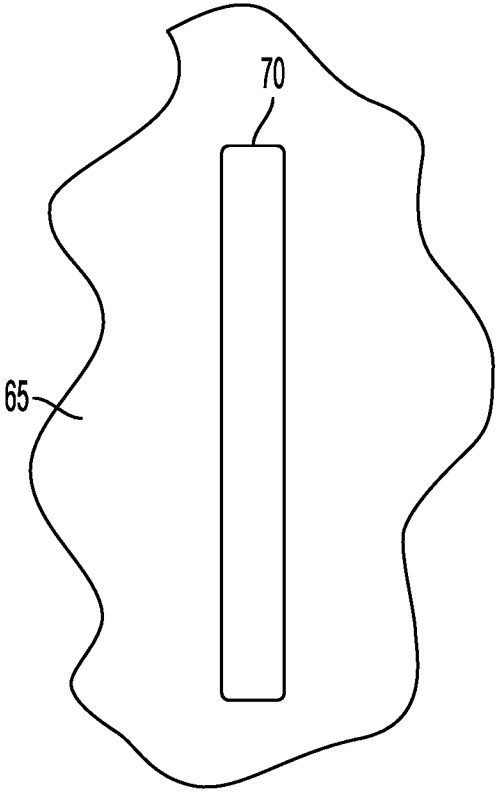

FIG. 6A shows a rectangle-shaped slit 70 that is formed in the mask body 65.

FIG. 6B shows a triangular-shaped slit 72 that has been formed in the mask body 65.

Figure 6D:
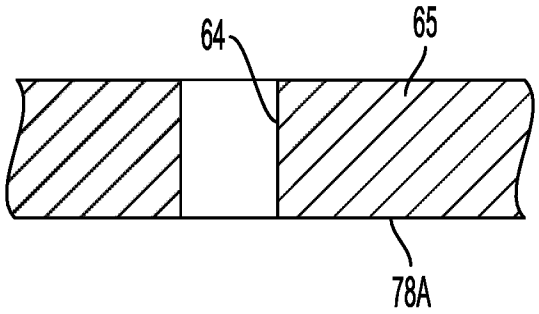
Figure 6C:
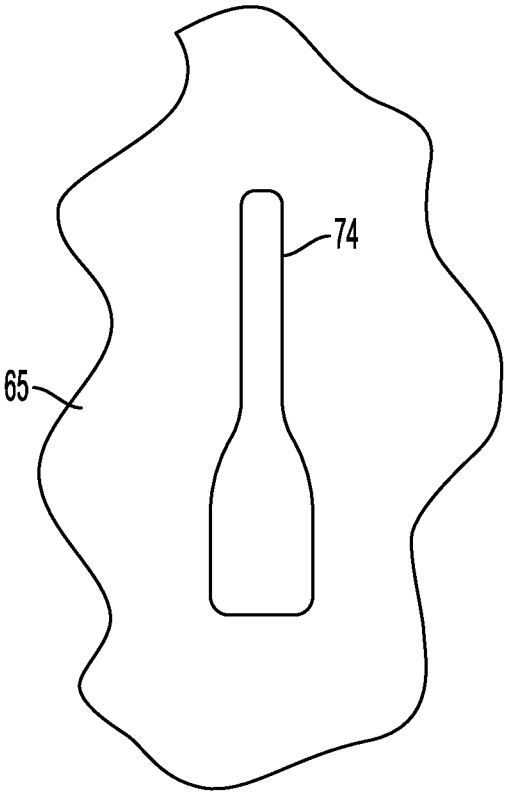

FIG. 6C shows an elongate-shaped slit 74, in which the width of the slit 74 changes with respect to the length of the slit 74. In the illustrated example, the slit 74 has a narrow top rectangular portion and a wide bottom portion to yield a slightly pear-shaped slit in the mask body 65.

In the preferred embodiment, the upper row of cylindrical mirror elements 36 of the mirror 20 looks downward and should have the most masking effect when pets are close to the detector. As a result, a slit design which is narrow at the top (which corresponds to the most downward-pointing field of view 16) and slightly wider at the bottom is best to condition the radiation to an optimal level (resulting in, for example, higher reduction of radiation from a very close range). In general, such a design looks like a triangle. For example, the triangle 72 of FIG. 6D is narrow at the top 77 (corresponding to radiation for close range) and wider at the bottom 76.

It should also be noted that the edge profile of the slit can vary.

Figure 6F:
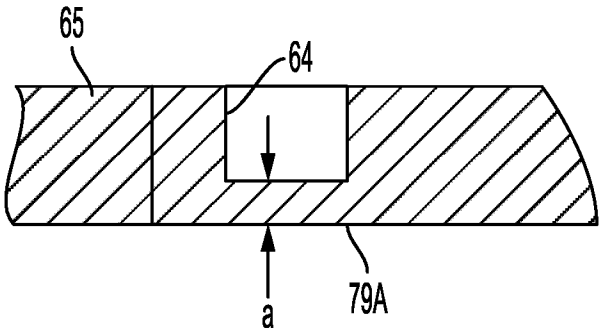
Figure 6E:
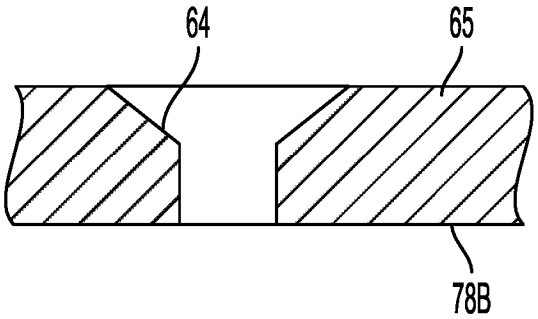

FIGS. 6D-6F show different cross-sectional views of alternative embodiments of edge profiles of the slit, with the shaded portions representing the mask body 65 and the white portions representing the cut away regions of the slit formed in the mask body 65.

In FIG. 6D, the slit edge 78A has a rectangular shaped cut away region.

In FIG. 6E, the slit edge 78B has a cut away region wherein the portion of the cut away region closer to one side of the mask is wider than the portion of the cut away region closer to the other side of the mask.

In FIG. 6F, the slit edge 79A has a cut away region that does not go all through the mask thickness. In this design pet immunity is achieved by a combination of the slit shape (length and width of the elongated shape) and the attenuation of the mask material with a certain width "a".

The material of the pet mask may also vary. It can be an infra-red semi-transparent material such as polyethylene, or a more non-transparent plastic such as ABS.

Further embodiments may allow the pet mask to be selectively removed or replaced by a different design of mask and slits. Such a replacement may be done by the installer on site.

Figure 7:
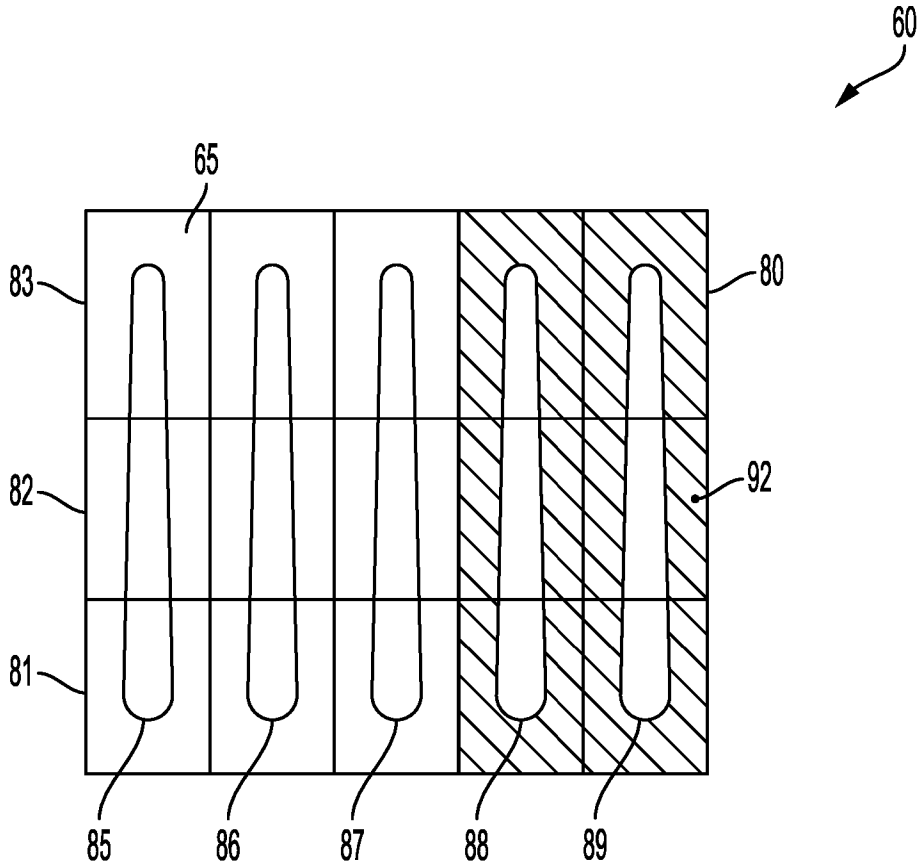
FIG. 7 shows an alternative embodiment of the pattern mask of the present invention.

FIG. 7 shows another way of implementing the pattern mask. Here, a mirror 80 is built with three rows 81, 82, 83 of mirror elements. The mirror 80 is basically implementing the same design as mirror 20. The mirror 80 includes low or unreflective, region 92 and slit shaped reflective regions 85, 86, 87, 88, 89, which are highly reflective to infrared radiation. Such a mirror coating technique removes the need for an additional pet mask body. Making the matte region 92 unreflective is most commonly done by making the lens material (most commonly ABS or PC) matte during mold injection, rather than making the mirror coating matte. Another way to look at this is engraving the pet mask into the mirror, or doing a mirror element optics in the shape of the elongated design to achieve pet immunity.

In another embodiment, the mask is placed separately from the mirror. In designs described above, the pet mask is close to the mirror and installed on it. The pet mask can be placed anywhere in the optical path of the detector, with some distance from the mirror.

Figure 8:
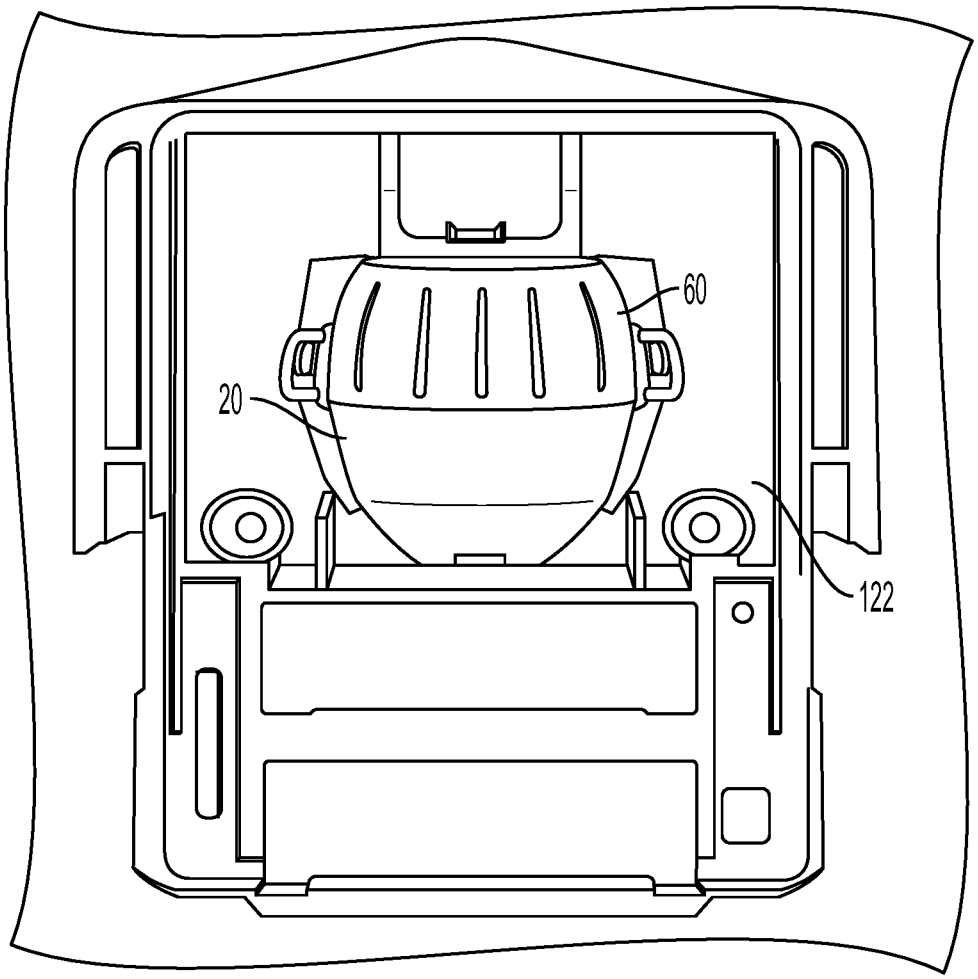
FIG. 8 is an image of parts of the inventive infrared motion detector.

FIG. 8 shows the mask 60 placed over a mirror 20 and the mirror attached to a rear wall 122 of a sensor housing 12.

While this invention has been particularly shown and described with references to preferred embodiments thereof, it will be understood by those skilled in the art that various changes in form and details may be made therein without departing from the scope of the invention encompassed by the appended claims.

What is claimed is:

1. An infrared motion detector, comprising:

an infrared sensor for detecting infrared radiation;

a mirror for reflecting infrared radiation to the infrared sensor from at least a first elevation field of view and a second elevation field of view; and a pattern mask comprising vertically-elongated regions and covering only a portion of the mirror that corresponds to the first elevation field of view.

2. The infrared motion detector of claim 1, wherein the pattern mask attenuates infrared radiation only from the first elevation field of view.

3. The infrared motion detector of claim 1, wherein the mirror has a cylindrical curvature, wherein the mirror comprises at least an upper row of mirror optical elements creating the first elevation field of view and a lower row of mirror optical elements creating the second elevation field of view, wherein each one of the upper row of mirror optical elements and the lower row of mirror optical elements extends laterally across the mirror, wherein, in each one of the upper row of mirror optical elements and the lower row of mirror optical elements, each optical mirror element corresponds to a different azimuthal field of view.

4. The infrared motion detector of claim 1, wherein a portion of the mirror that reflects the infrared radiation that passes through the pattern mask is cylindrical.

5. The infrared motion detector of claim 1, wherein the pattern mask comprises a mask body in front of the mirror.

6. The infrared motion detector of claim 1, wherein the pattern mask comprises patterned reflective regions of the mirror.

7. The infrared motion detector of claim 1, wherein the vertically-elongated regions comprise slits.

8. The infrared motion detector of claim 1, wherein the pattern mask allows radiation from the vertically-elongated regions to reach the infrared sensor.

9. The infrared motion detector of claim 1, wherein widths of the vertically-elongated regions increase over their length.

10. The infrared motion detector of claim 1, wherein the vertically-elongated regions extend completely through a body of the pattern mask.

11. The infrared motion detector of claim 1, wherein the vertically-elongated regions extend only partially through a body of the pattern mask.

12. The infrared motion detector of claim 1, wherein a profile of the vertically-elongated regions changes with depth.

13. A method of operation of an infrared motion detector, comprising:

receiving, by a mirror, infrared radiation from at least a first elevation field of view and a second elevation field of view, wherein a pattern mask comprising vertically-elongated regions covers only a portion of the mirror that corresponds to the first elevation field of view;

reflecting, by the mirror, the infrared radiation to an infrared sensor; and detecting the infrared radiation with the infrared sensor.

14. The method of claim 13, wherein the pattern mask attenuates infrared radiation only from the first elevation field of view.

15. The method of claim 13, wherein the mirror has a cylindrical curvature.

16. The method of claim 13, wherein the pattern mask comprises a mask body in front of the mirror.

17. The method of claim 13, wherein the pattern mask comprises patterned reflective regions of the mirror.

18. The method of claim 13, wherein the vertically-elongated regions comprise slits.

19. The method of claim 18, wherein the pattern mask allows radiation from the vertically-elongated regions to reach the infrared sensor.

20. An infrared intrusion detector, comprising:

an infrared sensor for detecting infrared radiation; and a mirror for reflecting infrared radiation to the infrared sensor from at least a first elevation field of view and a second elevation field of view, wherein the mirror comprises at least an upper row of mirror optical elements creating the first elevation field of view and a lower row of mirror optical elements creating the second elevation field of view, wherein the upper row of mirror optical elements comprises unreflective matte regions and vertically-elongated reflective regions.

* * * * *